US005749770A

United States Patent [19]

Uzumcu et al.

[11] Patent Number: 5,749,770

[45] Date of Patent: May 12, 1998

[54] METHOD AND APPARATUS FOR SANDING A PLURALITY OF WORK-PIECES HAVING RESPECTIVE SURFACES OF VARYING CONTOURS

[75] Inventors: Albert I. Uzumcu, Hoffman Estates; Matthew Malone, River Grove; Russell J. Schweizer, Crystal Lake, all of Ill.

[73] Assignee: S-B Power Tool Company, Chicago, Ill.

[21] Appl. No.: 675,224

[22] Filed: Jul. 8, 1996

[51] Int. Cl.[6] ..... B24B 1/00; B24B 7/19; B24B 7/30

[52] U.S. Cl. ..... 451/28; 451/356; 451/351

[58] Field of Search ..... 451/356, 351, 451/527, 489, 490, 495, 496, 497, 502, 503, 28

[56] References Cited

U.S. PATENT DOCUMENTS

| | | | |
|---|---|---|---|
| 2,103,320 | 12/1937 | Corff | 451/503 |
| 3,914,906 | 10/1975 | Barnes | 51/170 |
| 4,018,574 | 4/1977 | Dyer | 451/531 |
| 4,067,149 | 1/1978 | Ali et al. | 451/496 |
| 5,387,251 | 2/1995 | Rouse | 451/495 |
| 5,554,066 | 9/1996 | Bosten | 451/356 |
| 5,564,971 | 10/1996 | Evensen | 451/490 |

FOREIGN PATENT DOCUMENTS

| | | |
|---|---|---|
| 2122082 | 10/1994 | Canada . |
| 8529793 | 2/1986 | Germany . |
| 241056 | 2/1946 | Switzerland . |

OTHER PUBLICATIONS

Porter Cable Model 444 Profile Sander Instruction Manual, pp. 1–16, 1996.

Tadpole II Contour Sanding Grips Advertisement, 1993.

Red Devil Sandpaper Holder (Packaging Folder, Figures 1 And 2 And Descriptive Statement.).

*Primary Examiner*—D. S. Meislin

*Assistant Examiner*—Derris H. Banks

*Attorney, Agent, or Firm*—Jones, Day, Reavis & Pogue

[57] ABSTRACT

The present invention provides a new and improved sanding apparatus which includes a flexible tubular member having an outer abrasive surface and a plurality of contour members adapted to be received one-at-a-time within the tubular member. The invention also includes the method of sanding by using the flexible tube and a plurality of the contour members.

14 Claims, 2 Drawing Sheets

METHOD AND APPARATUS FOR SANDING A PLURALITY OF WORK-PIECES HAVING RESPECTIVE SURFACES OF VARYING CONTOURS

The present invention relates to sanding equipment and methods for using the same. More particularly, the present invention relates to a method and apparatus for sanding a plurality of work-pieces having respective surfaces of varying contours.

BACKGROUND OF THE INVENTION

Many varieties of orbital and belt sanders are well known to those skilled in the sanding art. These sanders have moving planar surfaces and perform very efficiently when sanding flat surfaces. However, these sanders are of limited utility when it is desired to sand curved surfaces or other surfaces that are inaccessible to a flat abrasive member. Concave and convex surfaces, grooves, score lines, beads and shutter slats are examples of objects which cannot be properly sanded using orbital or belt sanders.

It is known in the prior art to provide so-called profile sanders for sanding surfaces which are inaccessible to orbital and belt sanders. These prior art devices are both powered and manually operated.

An example of a powered profile sander is the Model 444 sander manufactured by Porter-Cable Corporation. The Model 444 profile sander, as shown in Bosten et al. U.S. Pat. No. 5,554,066, includes a mounting plate and a plurality of profile members, each having a portion configured to correspond to the contour of the surface to be sanded. This device is disadvantageous in that the flat sheets of abrasive material must be affixed to the profile member by an adhesive material. Thus, a significant portion of the sanding sheet is used only for securing the sanding sheet to the profile member. When the small portion of the sanding sheet that contacts the work is worn, it is necessary to discard the entire sheet including the portions which cannot be used for sanding. Accordingly, considerable quantities of the sanding sheet material are wasted in the sense that significant portions of these sheets cannot be used for their intended purpose, namely, sanding.

An example of manually operated profile sanding is represented by the TADPOLE II sanding grips manufactured by Perfect Panel Products of Auburn, Wash. The profile members are provided in different shapes with sections configured to conform to the surface of the object to be sanded. A sheet of sandpaper is manually wrapped around the profile member and held in place by the user when the device is manually operated. This device is disadvantageous in that it is manually operated. Further, all portions of the sanding sheet cannot be used for sanding as the end or edge portions of the sheet must be used for manually gripping the sheet and holding the same against the profile member.

Accordingly, there is a need in the art for a new and improved sanding apparatus and method for sanding surfaces of varying contours.

SUMMARY AND OBJECTS OF THE PRESENT INVENTION

The present invention provides a new and improved sanding apparatus which includes a flexible tubular member having an outer abrasive surface and a plurality of contour members adapted to be received one-at-a-time within the tubular member. The invention also includes the method of sanding by using the flexible tube or tubes and a plurality of the contour members.

A primary object of the present invention is the provision of a new and improved apparatus and method for sanding a plurality of work-pieces having respective surfaces of varying contours.

One object of the present invention is the provision of a sanding apparatus having a flexible tubular member with an outer abrasive surface and a plurality of contour members, each contour member having a cross-section defined by a first portion and a second portion, the first portion of each contour member having the same cross-sectional shape as the first portions of the other contour members, the second portion of each contour member having a cross-sectional shape which is different from the cross-sectional shape of the second portions of the other contour members and including a contour section configured to conform substantially to the shape of the work-piece to be sanded, each contour member being adapted to be received one-at-a-time within the tubular member and being dimensioned such that the tubular member will be in a taut condition when the tubular member has one of the contour members received therein and (1) is clamped to the first portion of the contour member and (2) has the abrasive area thereof adjacent the contour section of the contour member brought into engagement with the work-piece to be sanded.

Another object of the present invention is the provision of a method for sanding a plurality of work-pieces having respective surfaces of varying contours comprising the steps of: providing a plurality of identical flexible tubes of constant diameter each having an outer abrasive surface; providing a plurality of contour members, each having a cross-section defined by a first portion and a second portion, the first portion of each contour member having the same cross-sectional shape as the first portions of the other contour members, the second portion of each contour member having a cross-sectional shape which is different from the cross-sectional shape of the second portions of the other contour members and including a contour section configured to conform substantially to the shape of the work-piece to be sanded, each contour member being adapted to be received one-at-a-time within the tubular member and being dimensioned such that the tubular member will be in a taut condition when the tubular has one of the contour members received therein and (1) is clamped to the first portion of the contour member and (2) has the abrasive area thereof adjacent the contour section of the contour member brought into engagement with the work-piece to be sanded; inserting a selected one of the contour members into one of the tubular members; applying a clamping force to the portion of the tubular member which contains the first portion of the selected contour member; placing the outer abrasive area of the tubular member which is adjacent the contour section of the contour member into engagement with the work-piece to be sanded; and then applying reciprocating movement to the tubular member with the selected contour member therein.

Still another object of the present invention is the provision of a sanding apparatus and method which permits use of the entire abrasive surface of the sanding material for the sanding operation.

These and other objects and advantages of the present invention will become apparent from the following specification disclosing a preferred embodiment.

DESCRIPTION OF A PREFERRED EMBODIMENT

Figure 1:
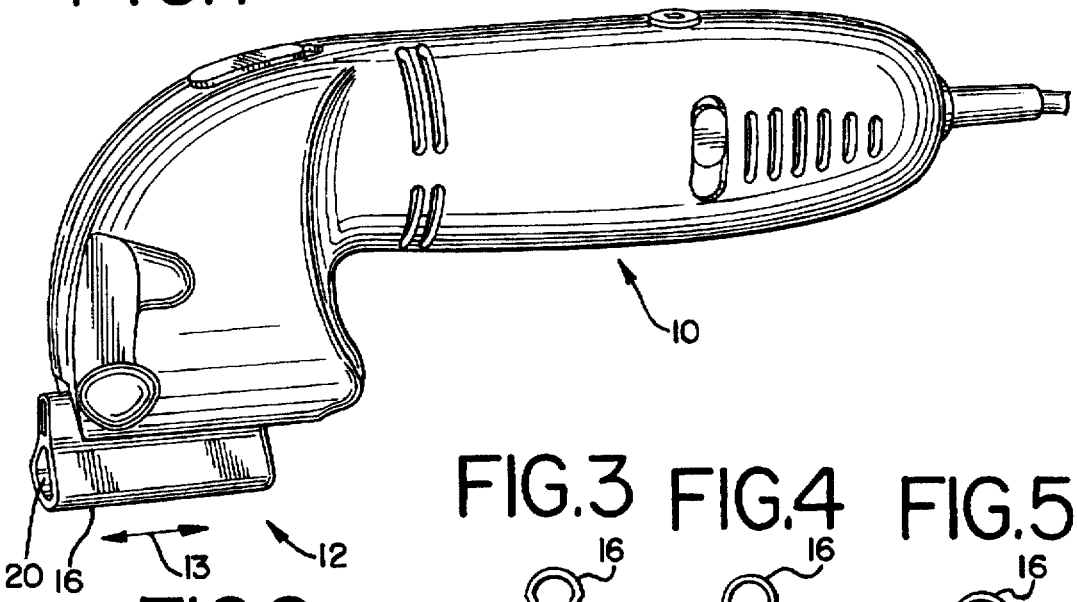
FIG. 1 is an isometric view of a powered sander which may utilize the apparatus of the present invention and which may be employed to carry out the method of the present invention.

Referring first to FIG. 1, a powered sander, generally designated 10, is shown in association with one embodiment of the sanding apparatus of the present invention, generally designated 12. It will be understood that the sander 10 includes a motor, preferably an electric motor, for reciprocating the member 12 in the directions indicated by the arrows 13. The sander 10 is preferably of the type disclosed and claimed in application, attorney docket 960502, Ser. No. 08/693,805, filed Aug. 1, 1996, and assigned to the assignee of the present application. Although the apparatus 12 can be reciprocated by hand to perform a sanding operation, the apparatus and method of the present invention preferably utilize a powered sander.

Figure 2:
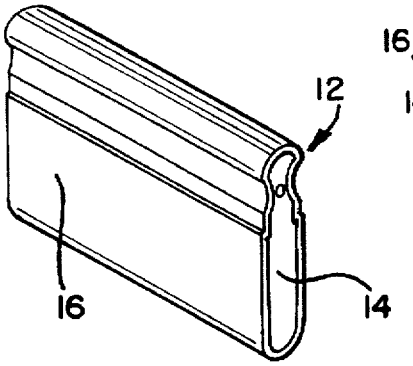
FIG. 2 is an isometric view of a flexible tubular member with an outer abrasive surface and having a contour member received therein.
Figure 17:
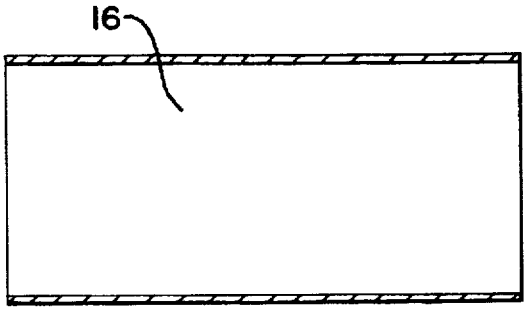
FIG. 17 is a longitudinal section taken through the tubular member.
Figure 18:
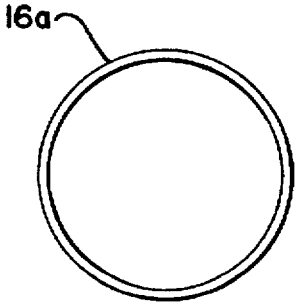
FIG. 18 is an end view of the tubular member.

Turning now to FIG. 2, a representative apparatus of the present invention includes a contour member 14 received within a tubular member 16. Referring to FIGS. 17 and 18, the tubular member 16 is provided in the form of a flexible tube having an outer abrasive surface 16*a*. The flexible material may be cloth-J weight, European cotton with an abrasive surface of aluminum oxide with a grit range of between 80–220 grit. The cloth may be joined to form a seam which extends either axially or helically of the tube. The joint may be glue with polyurethane. The present invention contemplates the provision of a plurality of identical tubes 16. That is to say, each tube 16 will have the same length and diameter.

Figure 3:
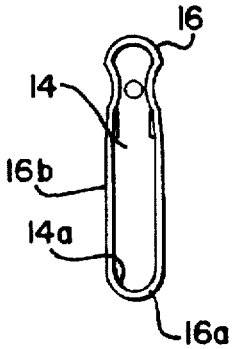
FIGS. 3–6 are end views of contour members with varying convex sections, each received within one of the tubular members.

FIG. 3 shows an end view of the contour member 14 received within a tubular member 16. It is noted that the contour member 14 has a convex section 14*a* which causes the area 16*a* of the tubular member to take the same convex shape; the area 16*a* will engage the work-piece to be sanded.

Figure 4:
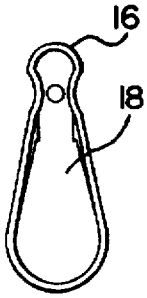
Figure 5:
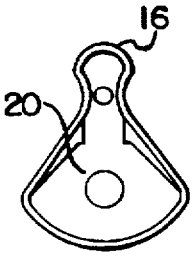
Figure 6:
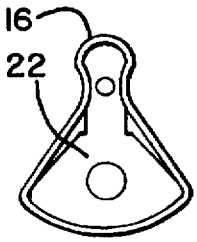
Figure 7:
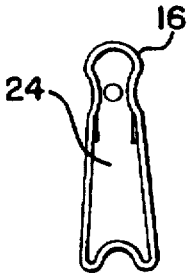
FIGS. 7–10 are end views of contour members with varying concave sections, each received within one of the tubular members.
Figure 8:
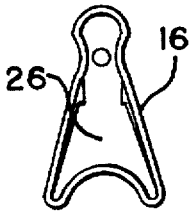
Figure 9:
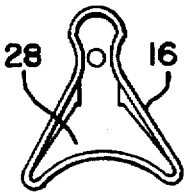
Figure 10:
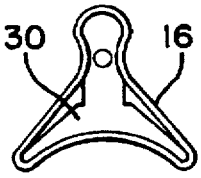

FIGS. 4, 5 and 6 show other forms of contour members 18, 20 and 22 respectively. Each of these contour members has a convex section. In each case, the contour member is received within one of the tubular members 16.

FIGS. 7–10 show respective contour members 24, 26, 28 and 30, each having a concave contour section. These contour members are dimensioned with respect to the diameter of the flexible sanding tube such that the tubular member will conform to the concave shape of each contour member when the sanding tube is clamped and brought into engagement with the work-piece.

Figure 11:
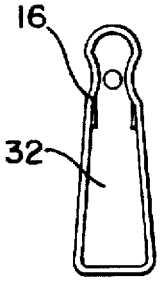
FIG. 11 is an end view of a contour member with a flat section and received within one of the tubular members.

FIG. 11 shows a contour member 32 having a flat contour section.

Figure 12:
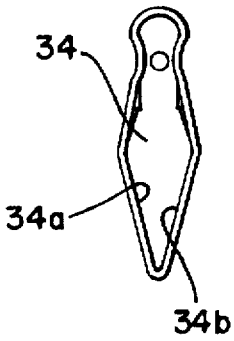
FIGS. 12 and 13 are end views of contour members having angle sections, each received within one of the tubular members.
Figure 13:
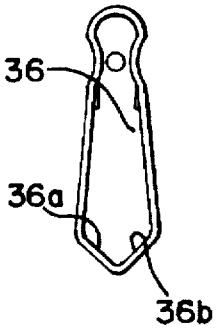

FIGS. 12 and 13 show respective contour members 34 and 36 each having an angle contour section. In this regard, the contour member 34 has planar walls 34*a* and 34*b* joining at a 30-degree angle. The contour member 36 includes planar walls 36*a* and 36*b* joining at a 90-degree angle.

Figure 14:
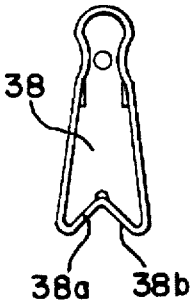
FIG. 14 is an end view of a contour member with a V-groove section and received within one of the tubular members.

FIG. 14 shows a contour member 38 defining a V-groove. In this respect, the contour member 38 includes planar walls 38*a* and 38*b* joining at an approximate 90-degree angle.

Figure 15:
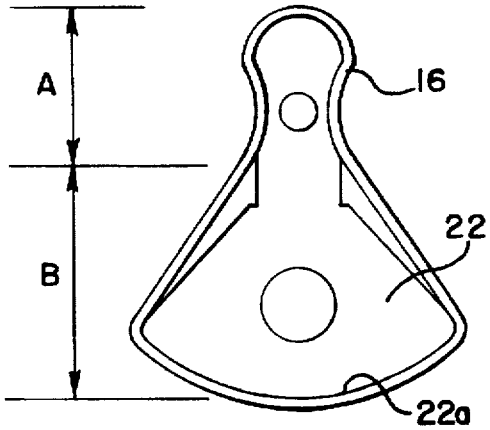
FIG. 15 is an enlarged view of a representative contour member received within one of the tubular members.

Attention is now invited to FIG. 15 which is an enlarged end view of the contour member 22 shown in FIG. 6. Each countour member has a cross-section contained in a plane perpendicular to the longitudinal axis of the contour member, i.e., the axis which extends along the length of the member. The contour member 22 has a cross-section including a first or upper portion contained in the region A; the cross-section of the remaining or second portion of the contour member is contained within the region B. The contour member 22 has a convex contour section 22*a*. It will be understood that the first portions A of all of the contour members are identical in cross-section. The second portions of the contour members vary in cross-sectional shape as shown in FIGS. 3–14.

Figure 16:
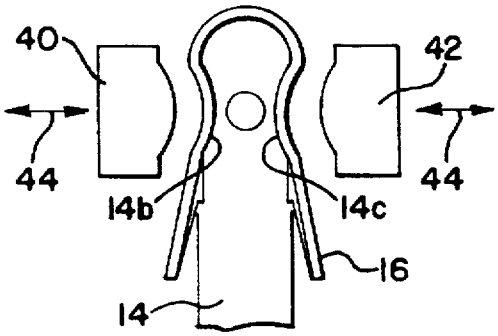
FIG. 16 is an enlarged, partial end view of a representative contour member received within one of the tubular members and associated with clamping jaws shown diagrammatically.

Reference should now be made to FIG. 16 showing an enlarged view of the first or upper portion of the contour member 14. The contour member has longitudinally extending, oppositely disposed arcuate recesses 14*b* and 14*c* shaped to conform to arcuate surfaces on the jaws 40 and 42 of a suitable clamping mechanism forming part of a powered sander. It will be understood that the clamping jaws 40 and 42 may be brought into and out of clamping engagement with the tube and contour member as indicated by the arrows 44.

As mentioned above, the invention contemplates the provision of a plurality of the tubes 16. Incidentally, the length of each tube will be the same as the length of the contour member. All contour members are preferably of the same length.

In use, a particular profile member will be selected depending on the contour or profile of the work-piece to be sanded. For example, if the work-piece has a convex contour, one of the concave profiles 24, 26, 28 or 30 (FIGS. 7–10) will be selected depending on the radius of the convex profile of the work-piece. The selected profile will then be inserted within one of the tubular sanding members 16. It will be understood that the flexible tubular member 16 will be in a taut condition when the contour member therein is in a clamped condition wherein the tube will be received within the clamping recesses, such as the recesses 14*b* and 14*c* of the contour member 14 shown in FIG. 16. With respect to the profiles having concave sections, such as the contour members 24, 26, 28 and 30, and the contour member 38 having the V-groove (FIG. 14), the tubular member will assume a fully taut condition when the concave or V-groove contour section is brought into engagement with the work-piece to be sanded.

The present invention provides a plurality of contour members of different shapes for sanding a number of surfaces having varying contours. Of course, contour members of other shapes may be provided. However, in each case the contour member will be dimensioned with respect to the diameter of the tubular member such that the flexible tubular member 16 will be in a taut condition when the tubular member with the selected contour member therein is clamped and is brought into engagement with the surface of the work-piece to be sanded.

The present invention is particularly advantageous in that all areas of the flexible tubular sanding member 16 may be utilized for sanding. Turning to the contour member 14, for example, the area 16*a* (FIG. 3) of the tubular member 16 will first be employed during a sanding operation. After the abrasive material in the area 16*a* has been substantially removed as a result of the sanding operation, the clamping forces will be released and the tube 16 will be manually repositioned by the user for placing another area of the tubular member, such as the area 16*b*, in adjacent relation with the profile section 14*a*. When the abrasive material in the area 16*b* has been worn away, a successive adjacent area of the tubular member will be placed adjacent the contour section 14*a*. Thus, it is apparent that the tubular member may be rolled or rotated clockwise or counterclockwise about each profile member until all areas of the tubular member have been used in the sanding operation. After the entire abrasive surface of the tubular member has been used, the operator will then discard the tube 16 and employ a fresh or unused tube to continue the sanding operation.

Although particular preferred embodiments of the invention have been disclosed in detail for illustrative purposes, it will be recognized that variations or modifications of the disclosed apparatus and method lie within the scope of the present invention as defined by the following claims.

We claim:

1. An apparatus for sanding a plurality of work-pieces having respective surfaces of varying contours comprising:

(a) a continuous flexible tubular member having an inner surface and an outer abrasive surface; and (b) a plurality of contour members each having a length as defined along a longitudinal axis of the contour member and each having a uniform cross-section in a plane perpendicular to said axis the cross-section being defined by a first external portion and a second external portion, the first portion of each contour member having the same cross-sectional shape as the first portions of the other contour members, the second portion of each contour member having a cross-sectional shape which is different from the cross-sectional shape of the second portions of the other contour members and including a contour section configured to conform substantially to the shape of the work-piece to be sanded, each contour member being received one-at-a-time within said tubular member with at least parts of said first external portion and said second external portion in engagement with the inner surface of the tubular member and each contour member being dimensioned such that the tubular member will be in a taut condition when the tubular member has one of the contour members received therein and (1) is clamped to the first portion of said one contour member and (2) has the abrasive surface thereof adjacent the contour section of said one contour member brought into engagement with the work-piece to be sanded.

2. The apparatus according to claim 1 wherein the contour section of at least one of said contour members is convex.

3. The apparatus according to claim 1 wherein the contour section of at least one of said contour members is concave.

4. The apparatus according to claim 1 wherein the contour section of at least one of said contour members is flat.

5. The apparatus according to claim 1 wherein the contour section of at least one of said contour members consists of first and second planar surfaces extending away from the first portion of said one contour member and joining at an approximate 30-degree angle.

6. The apparatus according to claim 1 wherein the contour section of at least one of said contour members consists of first and second planar surfaces extending away from the first portion of said one contour member and joining at an approximate 90-degree angle.

7. The apparatus according to claim 1 wherein the contour section of at least one of said contour members consists of first and second planar surfaces extending toward the first portion of said one contour member and joining at an approximate 90-degree angle.

8. The apparatus according to claim 1 wherein the first portion of each contour member has oppositely, outwardly disposed recesses for receiving clamping members.

9. The apparatus according to claim 1 wherein said flexible tubular member consists of a fabric-like member having an aluminum oxide abrasive surface.

10. The method of sanding a plurality of work-pieces having respective surfaces of varying contours comprising the steps of:

(a) providing a plurality of continuous flexible tubular members of constant diameter each having an inner surface and an outer abrasive surface;

(b) providing a plurality of contour members each having a length as defined along a longitudinal axis of the contour member and each having a uniform cross-section in a plane perpendicular to said axis, the cross-section being defined by a first external portion and a second external portion, the first portion of each contour member having the same cross-sectional shape as the first portions of the other contour members, the second portion of each contour member having a cross-sectional shape which is different from the cross-sectional shape of the second portions of the other contour members and including a contour section configured to conform substantially to the shape of the work-piece to be sanded, each contour member being adapted to be received one-at-a-time within said tubular members with at least parts of said first external portion and said second external portion in engagement with the inner surface of the tubular member and each contour member being dimensioned such that each tubular member will be in a taut condition when the tubular member has one of the contour members received therein and (1) is clamped to the first portion of said one contour member and (2) has the abrasive surface thereof adjacent the contour section of said one contour member brought into engagement with the work-piece to be sanded;

(c) inserting a selected one of said contour members into one of said tubular members;

(d) applying a clamping force to the portion of the tubular member which contains the first portion of the selected contour member; and (e) placing the outer abrasive surface of the tubular member which is adjacent the contour section of the selected contour member into engagement with the work-piece to be sanded and applying reciprocating movement to the tubular member with the selected contour member therein.

11. The method according to claim 10 further the comprising the steps of:

(f) releasing the clamping force from the tubular member with the selected contour member therein;

(g) repositioning the tubular member with respect to the selected contour member such that said outer abrasive area of said tubular member is no longer adjacent the contour section of the selected contour member and another outer abrasive area of the tubular member is adjacent said contour section of the selected contour member;

(h) applying a clamping force to another portion of the tubular member which contains the first portion of the selected contour member;

(i) placing said another outer abrasive area of the tubular member which is adjacent the contour section of the selected contour member into engagement with the work-piece to be sanded and applying reciprocating movement to the tubular member with the selected contour member therein; and (j) continuing steps (f), (g), (h) and (i) hereof in sequence until substantially all outer abrasive surfaces of the tubular member have been clamped adjacent the contour section of the selected contour member.

12. The method according to claim 10 further comprising the steps of:

(f) releasing the clamping force from the tubular member with the selected contour member therein;

(g) removing the selected contour member from the tubular member;

(h) inserting another contour member into one of the tubular members; and (i) repeating steps (d) and (e).

13. The method according to claim 11 further comprising the steps of:

(k) releasing the clamping force from the tubular member with the selected contour member therein;

(1) removing the selected contour member from the tubular member;

(m) inserting another contour member into one of the tubular members; and (n) repeating steps (d) and (e).

14. An apparatus for sanding a plurality of work-pieces having respective surfaces of varying contours comprising:

(a) a plurality of continuous flexible tubular members each having an outer abrasive surface and an inner surface and each having the same diameter and length; and (b) a plurality of contour members each having a length as defined along a longitudinal axis of the contour member and being substantially the same as the length of one of the tubular members, each contour member having a uniform cross-section in a plane perpendicular to said axis and defined by a first external portion and a second external portion, the first portion of each contour member having the same cross-sectional shape as the first portions of the other contour members, the second portion of each contour member having a cross-sectional shape which is different from the cross-sectional shape of the second portions of the other contour members and including a contour section configured to conform substantially to the shape of the work-piece to be sanded, each contour member being received one-at-a-time within one of said tubular members with at least parts of said first external portion and said second external portion in engagement with the inner surface of said tubular member and each tubular member being dimensioned such that said one tubular member will be in a taut condition when any one of the contour members is received therein and (1) is clamped to the first portion of said one contour member and (2) has the abrasive surface thereof adjacent the contour section of said one contour member brought into engagement with the work-piece to be sanded.

* * * * *